United States Patent [19]

Hofmann

[11] Patent Number: 4,706,889

[45] Date of Patent: Nov. 17, 1987

[54] SPRAY-SHOWER WITH NOZZLES, PARTICULARLY FLAT FAN NOZZLES

[75] Inventor: Hans J. Hofmann, Nashua, N.H.

[73] Assignee: Spraco, Inc., Nashua, N.H.

[21] Appl. No.: 386,308

[22] Filed: Jun. 8, 1982

[30] Foreign Application Priority Data

Feb. 12, 1982 [DE] Fed. Rep. of Germany ..... 3204955

[51] Int. Cl.[4] ..... B05B 13/02

[52] U.S. Cl. ..... 239/550; 239/566; 239/567; 239/568; 239/600; 285/189

[58] Field of Search ..... 239/550, 551, 566, 567, 239/568, 599, 600, 559, 596, 597, 159, 287; 285/189

[56] References Cited

U.S. PATENT DOCUMENTS

| | | | |
|---|---|---|---|
| 3,191,871 | 6/1965 | Palmer | 239/159 |
| 3,214,199 | 10/1965 | Brooks | 285/189 |
| 3,273,805 | 9/1966 | Hall | 239/600 |
| 3,953,555 | 4/1976 | Gley | 239/550 |
| 3,987,964 | 10/1976 | Pittman et al. | 239/287 |

FOREIGN PATENT DOCUMENTS

| | | | |
|---|---|---|---|
| 514734 | 7/1955 | Canada | 239/599 |
| 750392 | 8/1933 | France | 239/550 |
| 321294 | 2/1972 | U.S.S.R. | 239/599 |

*Primary Examiner*—Andres Kashnikow

*Attorney, Agent, or Firm*—Charles Hieken

[57] ABSTRACT

A spray-shower pipe is equipped with flat fan nozzles having a dome-shaped indentation directed to the pipe inside and located inside a nozzle base formed with a recess that conforms with and engages the outer surface of the pipe wall and an annular extension of length corresponding to the pipe wall thickness at the circumference of the opening in which the extension is snugly seated. The front surface of the extension facing the inside of the pipe has a curvature which corresponds to the curvature of the pipe wall inside surface. The dome-shaped indentation is formed with an aperture that forms an angle with the longitudinal axis of the pipe that is slightly less than 90°, typically 83°.

11 Claims, 4 Drawing Figures

SPRAY-SHOWER WITH NOZZLES, PARTICULARLY FLAT FAN NOZZLES

Figure 2:
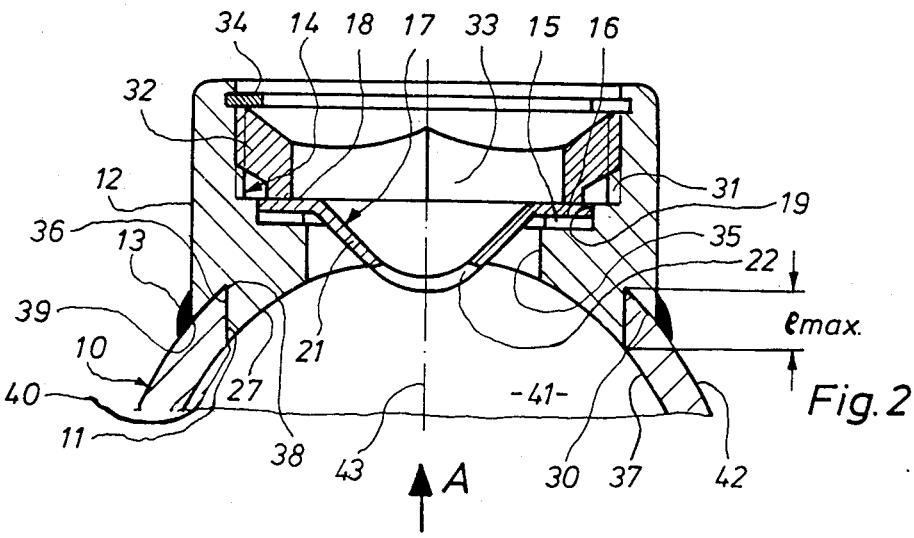

The invention is related to a spray-shower with nozzles, particularly flat fan nozzles, in which the nozzles, extending into the inside of the pipe or spray-shower, are mounted inside a cylindrical nozzle-base, which, for its part, is inserted radially into a drill-hole of the spray-shower, supporting itself with a recess at the outside wall of the spray-shower and whereby the front surface of the nozzle base, directed to the inside of the spray-shower, shows a curvature corresponding to the radius of the inside wall of the spray-shower.

Showers of the above mentioned type are used, for example, in the pulp and paper industry. Therein, it is necessary to align the nozzles, generally flat-fan-nozzles, equally spaced on the generatix of the spray-shower with regard to their discharge orifice in such a way that the flat spray pattern of each is not obstructed by another. With a slight skewing (of about 7°) of the nozzle discharge orifice in relation to the longitudinal axis of the spray-shower, this goal will be obtained. The flat spray patterns are no longer aligned along the pipe direction, but inclined within a small angle (approximately 7°) relative to the longitudinal axis of the spray-shower resulting in parallel flat spray patterns. This inclined location of the discharge orifice also results in an overlap of the ends of the flat spray pattern.

Another important requirement of such spray-shower is that the nozzles, having for this reason a dome shaped indentation, extend far enough inside the pipe so that the periodic and faultless cleaning of the nozzle orifices is guaranteed by an axial to and fro moving and/or turning, for example, of brush-type, cleaning devices located inside the spray-shower.

To satisfy the mentioned requirements it is well known to locate the nozzles separately in nozzle bases, which are inserted in radial drilled holes of the spray-shower, extending into the respective radial drilled holes of the spray-shower with a part designed as a tap. These known nozzle bases are made in general out of stainless steel and are designed as being machined on a lathe, whereby the required boreholes, tap and recess are manufactured through expensive material detaching machining.

After inserting the nozzle bases into the drilled holes of the spray-shower, the nozzle base is welded to the spray pipe at the outside circumference and so undetachably connected to it. This welding process is, in practice, beset by difficulties, because the nozzle base with the machined recess shows only two diametrically opposed punctiformed places of contact with the outside surface of the spray-shower. The use of holding devices is necessary, which align the nozzle base to the required position and hold it during the welding process.

Another difficulty during the welding procedure occurs because of the gap between the recess of the nozzle base and the surface of the spray-shower—with exception of the two mentioned places of contact—which, because of the described geometrical relationship grows to a maximum and then reduces to zero (at place of contact). These difficulties set high requirements for the skill of the welder, if scrap or bad finish of the welding connection is to be avoided.

An object of the present invention is to design a spray-shower of the above mentioned type in a way to effect an easier, faster, more exact and cost-reducing connection of the nozzle base to the spray pipe, and at the same time a substantial reduction of the scrap percentage.

According to the invention, the outside edge and the inside edge of the recess of the nozzle base have a shape corresponding to the respective line of self-intersection of the nozzle base with the surface of the spray-shower and the nozzle base is designed as a cast part, preferably an investment casting.

More particularly, the invention comprises spray-shower apparatus for insertion into an opening in the spray-shower pipe having a curved inside surface and a curved outside surface. Nozzle base means is for supporting a spray-shower nozzle means in predetermined relationship to the pipe axis with the plane of the fan spray emitted by the nozzle means forming an angle with the pipe axis slightly greater than zero so that the ends of the fan spray overlap the ends of any adjacent fan spray emitted by adjacent nozzle means seated in the pipe without interference and having a front surface for facing the inside of the pipe that is curved in conformity with the inside surface of the pipe. The nozzle base means is formed with a recess for supporting itself at the pipe outside surface. The nozzle base means includes keying means for engagement with the nozzle means to maintain the nozzle means in the predetermined relationship when the nozzle means is seated in the nozzle base means and the nozzle base means is seated in an opening in the spray-shower pipe wall with the recess engaging the pipe outside surface.

The invention results in a favorable circumferential area of contact of the recess of the nozzle base with the surface of the spray-shower. Thereby the subsequent welding process will be easier and substantially simplified. The hitherto required expensive holding devices are no longer necessary.

Because the nozzle base, according to the invention, should be designed as a cast part, preferably investment casting, in addition to the just mentioned advantages are substantial simplifications in production, because all the boreholes, recesses and edges can be formed to it through the casting process without subsequent material detaching machining.

Figure 1:
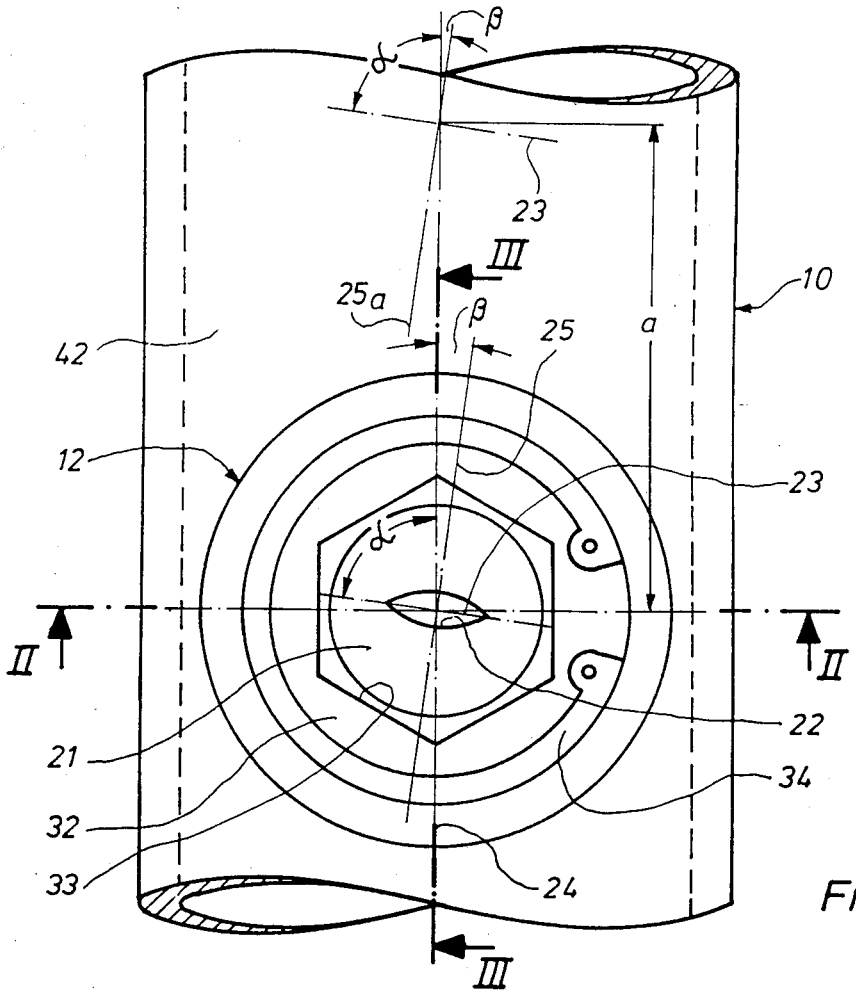
Figure 3:
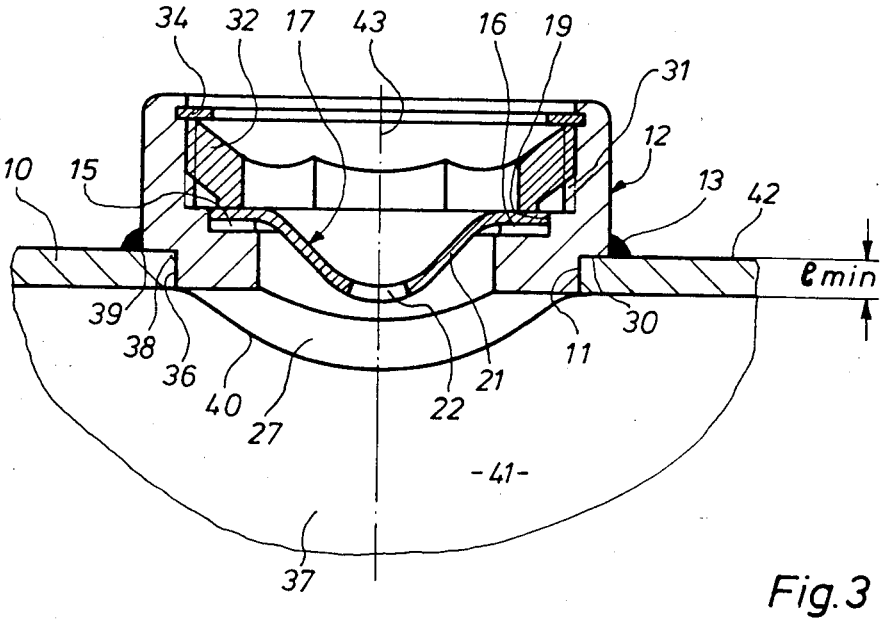
Figure 4:
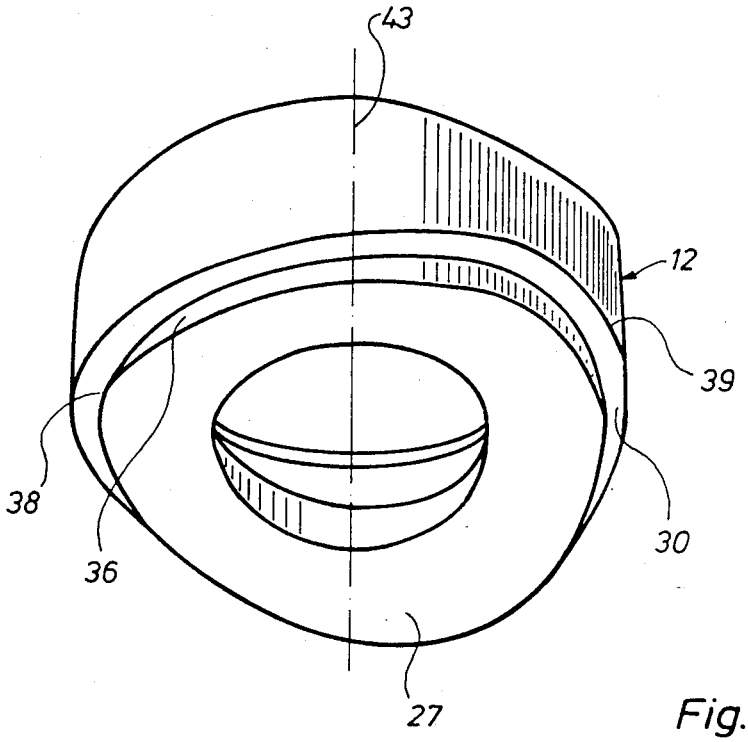

Numerous other features, objects and advantages of the invention will become apparent from the following specification when read in connection with the accompanying drawing:

FIG. 1 shows a part of a spray-shower, showing the top view of the nozzle discharging orifice, FIG. 2 shows a section along line II—II in FIG. 1, FIG. 3 shows a section along line III—III in FIG. 1, and FIG. 4 shows a nozzle base shown in FIGS. 1, 2 and 3 as a separate part shown in perspective.

In FIGS. 1 and 2 is shown a (partial) spray-shower marked (10). The spray-shower (10) shows on its surface (in FIGS. 1 and 2) a multitude of holes (11), equally spaced by distance (a) in which is put a nozzle base marked (12). In FIGS. 1 and 2 is shown only one hole (11) and one nozzle base (12). The nozzle bases (12), which are preferably designed as an investment casting (stainless steel or titanium), can—after insertion in the respective holes (11) of the spray-shower (10)—be welded to the spray-shower as indicated at (13).

As follows also from FIGS. 2 and 3, the nozzle base (12) has a cylindrical multi-faceted recess (14), which can be worked into it during the casting process. On a recess (15) at the borehole (14) is located a gasket (16), made of an elastic material. On the gasket (16) lies a flat fan nozzle marked (17) with its horizontal flange-type side (18). The flat fan nozzle (17) could be designed as a stamped, respectively punched part, having at its outer circumference an axially symmetrical, octagon shape. Correspondingly, the nozzle base (12) could have a recess (14) in the area provided for the incorporation of the gasket (16) and the nozzle (17), which has an octagonal shape. The respective areas marked with (19) forming the inner octagon of the nozzle base (12), serve as stops for the corresponding sides of the flat fan nozzles (17). The flat fan nozzle (17) is thereby in the assembly position, shown in FIGS. 1, 2 and 3, connected to the nozzle base (12) rotationally stable.

FIGS. 2 and 3 further make clear that the flat fan nozzle (17) has a dome-shaped indentation (21) directed to the inside of the spray-shower (10). At the minimum of the spherical dome-shaped indentation (21) is located the nozzle discharge orifice (22), whose longitudinal axis is marked (23) in FIG. 1.

FIG. 1 shows that the longitudinal axis (23) of the nozzle discharge orifice (22) jointly with the spray-shower longitudinal axis marked (24), subtend an angle $\alpha$ of approximately 83° preferably 82.5°. The plane of the flat spray patterns produced by the nozzle discharge orifice (22) is indicated in FIG. 1 with a dotted line and marked (25). The plane (25) of the flat spray pattern is located at a right angle to the longitudinal axis (23) of the nozzle discharge orifice (22). Based on the inclination of the nozzle discharge orifice (22) in relation to the longitudinal axis (24) of the spray-shower there will be obtained a closed angle $\beta$ of approximately 7°, preferably 7.5° between the flat spray pattern (25) and the spray-shower longitudinal axis (24). Since a corresponding inclination of the flat spray pattern is also provided for the next following flat spray pattern (25*a*) of the spray-shower (10), a parallel position of the flat spray patterns to one another of the spray-shower (10) is achieved, to avoid the mutual impediment of neighboring flat spray patterns.

After insertion of the flat fan nozzle (17) into the mating inner octagon (19) of the nozzle base (12) it is necessary to fix the flat fan nozzle (17) also in the direction of arrow A (see FIG. 2). For this purpose the cylindrical recess (14) of the nozzle base (12) has in the zone of the largest diameter an internal thread (31). Into this internal thread (31) is screwed a threaded retaining plug (32) which has a multi-sided opening (33) inside. This opening (33) allows the pass through of the flat spray pattern (in direction of arrow A). The multi-sided opening (33) allows insertion of the retaining plug (32) through a corresponding screw spanner. In the assembled position shown in FIG. 2, the retaining plug (32) is pressing with the recessed interface onto the side (18) of the flat fan nozzle (17) with simultaneous compressive-load application of the gasket (16). At the external interface, the retaining plug is secured by a spring-ring (34), installed inside the nozzle base (12).

The flat fan nozzle (17) located and fixed in this manner inside the nozzle base (12) is seated—as shown in FIG. 2—with the dome-shaped indentation (21) and nozzle discharge orifice (22) through the diameter, marked (35), at the smallest area of the recess (14). Therefore, the nozzle discharge orifice (22) could be reached by an axial to and fro moving and/or turning cleaning device (not shown), located inside the spray-shower (10).

The drawing (compare especially FIGS. 2 and 3) makes clear, that for the cleaning purposes desired, the necessary extension of the discharge orifice (22) of the nozzle base into the inside of the spray-shower could be accomplished only with difficulties in relation to construction, if the nozzle base (12) would be placed at the outside of the spray-shower (10). It is in this case for the above mentioned reason an advantage, that the nozzle base (12) has a tap (36), which extends into the earlier mentioned drilled hole (11) of the spray-shower (10). The front surface, marked with 27, of the nozzle base (12) respectively of the tap (36) directed to the inside of the spray-shower shows a curvature—which is shown especially in FIGS. 2 and 4—corresponding to the inside wall (37) of the spray-shower (10).

To align the nozzle base (12) in the drawn assembly position, the nozzle base (12) has also a recess marked with (30). The perspective view in FIG. 4 makes clear that this recess (30) is formed by a symmetrical curved area. The symmetrical curved form of the recess (30) occurs because the inner edge (38) and the outer edge (39) of the above have a shape corresponding to the respective line of self-intersection of the nozzle base (12) with the external surface (42) of the spray-shower. Thereby the nozzle base (12) has in assembly position a brief contact of the recess (30) with the external surface of the spray-shower (42). The exact assembly position of the nozzle base (12) is directly established with the form of the recess (30) and makes holding devices and respective alignment devices unnecessary. Because of the contact of the edge (39) with the surface (42) of the spray-shower at the total circumference of the nozzle base (12) the welding procedure is substantially simplified.

FIGS. 2, 3 and 4 further also show, that the marked edge (40) of the curved front surface (27) of the nozzle base shows a curved shape. This shape corresponds to the line of self-intersection into the drilled hole (11) of extended nozzle-base-tap (36) with the inner surface (41) of the spray-shower (10). Thereby is obtained, that the length (1) into the drilled hole extended nozzle-base-tap (36) corresponds to the wall thickness of the spray-shower at the circumference of the drilled hole, measured in direction of the longitudinal axis (43) of the nozzle base.

Thereby the curved front surface (27) of the nozzle base (12) makes part of the inner surface (41) of the spray-shower (10), which avoids in an advantageous manner the creation of turbulences by edges, shoulders or rebounds.

There has been described novel apparatus and techniques for spray-showering with flat fan nozzles. It is evident that those skilled in the art may now make numerous uses and modifications of and departures from the specific apparatus and techniques disclosed herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Spray-shower apparatus for insertion into an opening in the spray-shower pipe having a curved inside surface and a curved outside surface comprising, nozzle base means for supporting a spray-shower nozzle means in predetermined relationship to the pipe axis with the plane of the fan spray emitted by the nozzle means forming an angle with said pipe axis slightly greater than zero so that the ends of said fan spray overlap the ends of any adjacent fan spray emitted by adjacent nozzle means seated in said pipe without interference and having a front surface for facing the inside of said pipe that is curved in conformity with the inside surface of said pipe, said nozzle base means being formed with a recess for supporting itself at said pipe outside surface, said nozzle base recess having a top edge and running edge of shape corresponding to respective lines of self-intersection of said nozzle base means with the outside surface of said pipe when seated thereon, said nozzle base means including keying means for engagement with said nozzle means to maintain said nozzle means in said predetermined relationship when said nozzle means is seated in said nozzle base means and said nozzle base means is seated in an opening in said spray-shower pipe wall with said recess engaging said pipe outside surface, said nozzle base means being a cast part, said pipe being formed with said opening, said nozzle base means being seated in said opening with said front surface conforming to said inside surface, said nozzle means being seated in said nozzle base means with means defining a slit-like aperture extending into said pipe radially inward of the inside surface thereof with the long axis of said aperture forming an angle with the axis of said pipe that is slightly less than 90°.

2. Spray-shower apparatus in accordance with claim 1 wherein said nozzle base means is formed with an annular protrusion of outside diameter corresponding substantially to the diameter of the opening in said pipe wall in which said nozzle base means is adapted to be seated.

3. Spray-shower apparatus in accordance with claim 2 wherein the length of said annular protrusion is substantially equal to the pipe wall thickness at the circumference of said opening in a direction along the longitudinal axis of said nozzle base means.

4. Spray-shower apparatus in accordance with claim 3 wherein said nozzle base means is stainless steel.

5. Spray-shower apparatus in accordance with claim 3 wherein said nozzle base means is made of titanium.

6. Spray-shower apparatus in accordance with claim 2 wherein said nozzle base means is stainless steel.

7. Spray-shower apparatus in accordance with claim 2 wherein said nozzle base means is made of titanium.

8. Spray-shower apparatus in accordance with claim 1 wherein said nozzle base means is stainless steel.

9. Spray-shower apparatus in accordance with claim 1 wherein said nozzle base means is made of titanium.

10. Spray-shower apparatus in accordance with claim 1 wherein said pipe is formed with a plurality of said openings, a corresponding plurality of said nozzle base means each being seated in a respective one of said openings with said front surface conforming to said inside surface.

11. Spray-shower apparatus in accordance with claim 1 wherein the angle formed by said aperture with the axis of said pipe is of the order of 83°.

* * * * *